United States Patent [19]

Hundebol

[11] Patent Number: 4,997,363

[45] Date of Patent: Mar. 5, 1991

[54] METHOD AND APPARATUS FOR PRODUCING CEMENT CLINKER

[75] Inventor: Soren Hundebol, Copenhagen, Denmark

[73] Assignee: F. L. Smidth & Co. A/S, Valby, Denmark

[21] Appl. No.: 448,745

[22] Filed: Dec. 11, 1989

[30] Foreign Application Priority Data

Jan. 18, 1989 [GB] United Kingdom ..... 8901082

[51] Int. Cl.[5] ..... F27B 7/02; F27B 15/00

[52] U.S. Cl. ..... 432/14; 432/106

[58] Field of Search ..... 432/58, 106, 14

[56] References Cited

U.S. PATENT DOCUMENTS 4,025,295 5/1977 Touborg ..... 430/106
4,059,396 11/1977 Dano ..... 432/78
4,295,823 10/1981 Ogawa et al. ..... 432/106
4,337,032 6/1982 Duplouy et al. ..... 432/106
4,349,331 9/1982 Flöter ..... 432/14
4,457,705 7/1984 Ramesohl et al. ..... 432/106
4,717,337 1/1988 Ichiyanagi et al. ..... 832/106
4,759,711 7/1988 Ichiyanagi et al. ..... 432/106

*Primary Examiner*—Henry C. Yuen
*Attorney, Agent, or Firm*—Brumbaugh, Graves, Donohue & Raymond

[57] ABSTRACT

A cement clinker-producing plant has a suspension preheater (1,2,3), a calciner (4) united with a stationary reactor (6) and coolers (7,8). Air is blown up through the cooler (7) into the reactor (6) where a spouted bed, in which the clinker is burnt, is produced. The air flow is controlled so that only clinker particles which have grown to a certain size can fall through the air flow into the cooler (7).

12 Claims, 3 Drawing Sheets

METHOD AND APPARATUS FOR PRODUCING CEMENT CLINKER

The invention relates to a a method for producing cement clinker from raw meal in an apparatus comprising a preheater, such as a suspension preheater, a calciner, a stationary reactor and first and second clinker coolers, wherein the raw meal is initially preheated in the preheater by means of hot exhaust gas from the calciner, which receives fuel, preheated combustion air from the second cooler and hot exhaust gas from the stationary reactor; and the preheated raw meal is calcined in the calciner and fed to the stationary reactor which is supplied with hot air from the first cooler, and possibly also fuel, and in which the calcined material is burned to cement clinker before being cooled in the first cooler and subsequently fed to the second cooler for additional cooling. The first and second coolers may be separate coolers or separate cooling compartments of a common cooler. Such a method is hereinafter referred to as of the kind described.

A method of this kind is known from EP-A-No. 0226329. According to that specification, the raw meal is calcined in a calciner having, in addition to the calcining chamber proper, immediately below the latter a vortex chamber for supply of secondary combustion air from the second cooler in a circulating motion to the overlying calciner, and, under this first vortex chamber, a second vortex chamber for separation of cement clinker which is conveyed to the calciner entrained in the combustion air from the stationary reactor. Cement clinker separated in the second vortex chamber is returned to the reactor via a sluice. In the stationary reactor calcined raw meal is burned in a fluid bed into cement clinker which is discharged from the bottom of the reactor into the first cooler. The specification states that the raw meal is calcined in the calciner to a degree of calcination of about 85% at a temperature of approximately 860° C. The hot combustion air from the reactor is carried via a mixing chamber to the second vortex chamber, the combustion air from the reactor being mixed with secondary combustion air from the second cooler in the mixing chamber.

It is the object of the invention to provide a method and hence an apparatus which is much simpler and less complex than the above known method and apparatus, and according to the invention a method of the kind described is characterised in that the burning in the stationary reactor takes place in a spouted bed; in that the raw meal is calcined in the calciner at a temperature higher than 950° C.; and in that air is blown into and through the first cooler and upwards into the bottom of the stationary reactor by a blower, the capacity of which is set to maintain such an air flow into the stationary reactor that only finish-burned clinker which exceeds a predetermined size can pass, under gravity against the air flow, from the stationary reactor to the first cooler.

A spouted bed usually consists of an upright cylindrical vessel which is connected with a gas inlet duct via a frusto-conical transition part at its lower end. If the vessel is filled with coarse particles, and if the gas velocity in the cylindrical vessel proper is set so that this velocity is smaller than the fall velocity of the particles, the particles cannot be conveyed through and out of the top of the vessel, but under the influence of the gas stream the particles are forced to adopt a characteristic circulating flow pattern in intimate contact with the flowing gas stream. Where air is utilized as gas supply, a fuel can be added to the spouted bed, and due to the intimate gas-to-particles contact the same temperature can be sustained across the entire bed. This advantageous effect is similar to that known from a fluid bed, but the fluid bed differs from a spouted bed in that the gas is introduced through a bottom plate having numerous small holes instead of one single central inlet opening. The gas distribution is more even across the cross-sectional area of the fluid bed, but since temperatures of more than 1300° C. are required to burn clinker and in that the air may be preheated up to 1100° C. it is virtually impossible to obtain materials for the bottom plate capable of withstanding the high temperatures. This problem does not arise in connection with a spouted bed.

According to the invention the raw meal is almost fully calcined in the calciner, and the hot calcined raw meal is led into the spouted bed where a large amount of nearly finished clinker, in varying sizes, is circulating and the raw meal will instantly stick to, especially, the smaller clinker particles and continue the reaction. The clinker particles will progressively be built up and after having attained a certain desired size where the clinker is regarded as finish-burned, the clinker will, because of the weight attained, be able to overcome the airstream entering the reactor from the first cooler and move under gravity towards the bottom of the reactor and further down into the first cooler in which the clinker is finally solidified into solid clinker and then fed to the second cooler for additional cooling.

When the stationary reactor is also supplied with fuel, combustion of which is nourished by the air from the first cooler, the temperature in the stationary reactor may be at least partly controlled by adjusting the fuel supply rate, without changing the air supply rate and hence the desired air flow into the stationary reactor. This supposes that the air flow into the stationary reactor is always greater than the air supply rate for nourishing the combustion of the maximum fuel to be combusted.

Hence it is possible to adjust separately the size of the finish-burned clinker and the temperature required for the burning in the reactor.

The temperature in the stationary reactor can be at least partly controlled by adjusting the temperature of the calcined raw meal supplied from the calciner. Since the burning of clinker in the reactor is an exothermic process, i.e. a process involving generation of heat, the fuel supply to the stationary reactor may sometimes be zero.

Where the raw meal has an alkali content which is undesirable in the burned clinker, a portion of the exhaust gas from the stationary reactor can be removed prior to the entry thereof into the calciner. This inevitably involves a loss of energy, but such a loss is neligible due to the low gas flow and fuel supply to the spouted bed.

The present invention also includes an apparatus for use in carrying out the method according to the invention, the apparatus comprising a preheater, a calciner, a stationary reactor constituted by an upright cylindrical vessel having at its lower end a frusto-conical wall, and first and second clinker coolers characterised in that the bottom of the frusto-conical wall is in open and direct connection with the top of the first clinker cooler through a common vertical central duct for simultaneous passage of both hot air from the cooler to the reactor and finish burned cement clinker from the reactor to the cooler, the vessel also being provided with one or more side inlets for calcined raw meal.

It is known from GB-A-No. 2112296 that a uniform clinker size may be obtained by using a bottom gas inlet duct to a reactor for classifying particles passing out of the reactor out of the duct. That specification discloses a fluid-bed reactor with a central inlet pipe at the bottom for the supply of combustion air and this inlet pipe acts simultaneously as an outlet duct for finish-burned clinker. However, this known arrangement consists of a highly complex system with a plurality of ducts and dampers for the supply of combustion air from the underlying cooler to the reactor and further the combined air intake/clinker discharge duct is provided with a sluice for the clinker. In contrast to this arrangement, the air intake/clinker discharge duct or pipe according to the present invention is in a simple open connection with the cooler without the relatively complex connections according to 2112296.

In the apparatus according to the present invention the calciner may be an upright cylindrical vessel with inlets for air, exhaust gas, fuel and raw meal at the bottom and an outlet for exhaust gas with suspended particles at the top, which outlet is connected with a separator for separation of calcined particles from the exhaust gas and supply of the particles to the stationary reactor.

The reactor diameter may be smaller than that of the calciner, and the reactor may be located centrally and immediately below the calciner and connected with the latter in such manner that the exhaust gas from the reactor can pass directly up into the calciner without any restriction. This is a distinct advantage in comparison with the above known apparatus in that there is no need for sluices, or other pressure loss incurring connections, between the calciner and the reactor so that the latter can be designed as an integral part of the calciner in the form of a small chamber at the bottom of the latter.

The invention will be described in further detail by way of example with reference to the accompanying drawings, in which.

Figure 1:
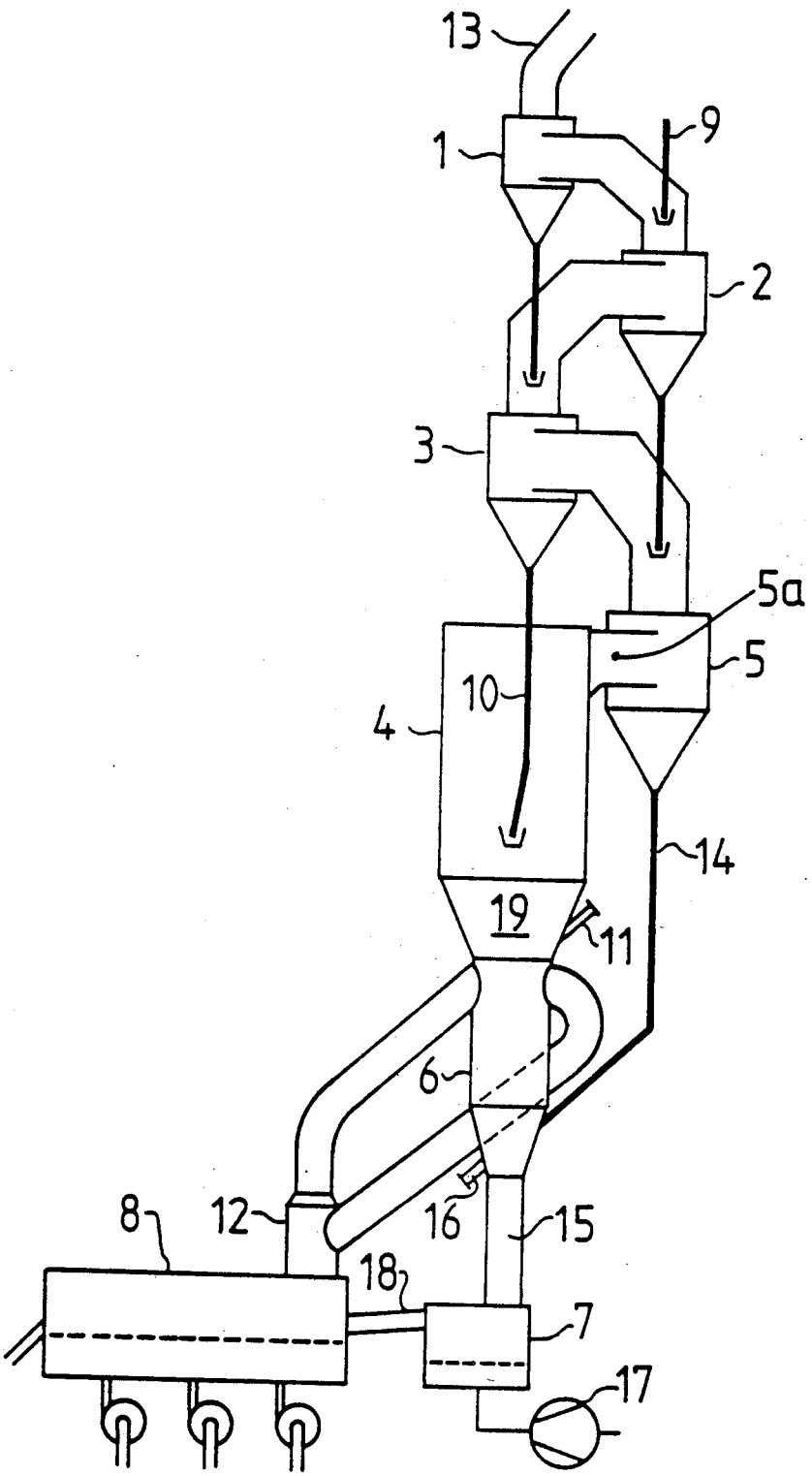
FIG. 1 shows diagrammatically an example of a plant according to the present invention.

The drawings show a plant for producing cement clinker, comprising a suspension preheater consisting of three preheater cyclones 1, 2 and 3, a calciner 4 with a separating cyclone 5, a stationary reactor 6 located under the calciner 4, a first clinker cooler 7 and a second clinker cooler 8.

Cement raw meal is fed to the plant at an inlet 9 and conveyed in known manner through the preheater cyclones 1, 2 and 3 to the calciner 4 via a duct 10. The calciner 4 is fed with fuel at an inlet 11 and combustion air through one or more ducts 12 from the second cooler 8.

In the calciner 4 the preheated raw meal is calcined in known manner in suspension, and the suspension of exhaust gas and calcined raw meal is conveyed via an outlet 5a to the separating cyclone 5, from which the exhaust gas is led up to the preheater 1, 2 and 3 and from the preheater, discharged from the plant through an exhaust gas outlet 13. The separated calcined raw meal is led from the separating cyclone 5 down into the reactor 6 via a duct 14.

The reactor 6 is supplied with combustion air from the first cooler 7 through a pipe 15 and with fuel through an inlet 16. A blower 17 supplies air to the cooler 7, which is supplied with finish-burned clinker from the reactor 6 via the pipe 15. From the first cooler 7 the clinker, which has finally solidified in the cooler, passes through a duct 18 into the second cooler 8 for final cooling.

As will be apparent from the drawing, the reactor 6 is located at the bottom of the calciner 4 and built-in as an integral part of a lower frusto-conical part 19 of the calciner so that the latter is fed with exhaust gas directly from the reactor 6.

Figure 2:
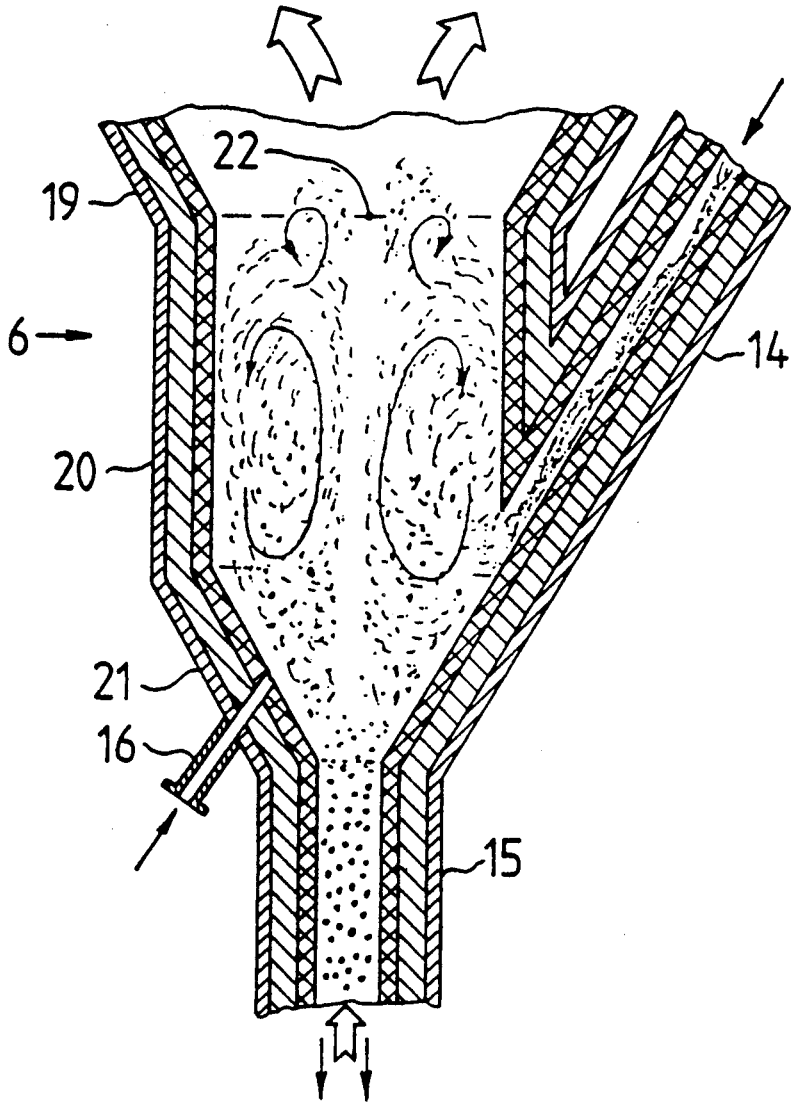
FIG. 2 is a vertical section through a stationary reactor used in the plant in FIG. 1; and, FIG. 3 shows diagrammatically a plant similar to that in FIG. 1 but with minor modifications.

FIG. 2 shows a vertical section of the reactor 6, which comprises a cylindrical vessel 20, a lower frusto-conical part 21, the previously mentioned inlets 14 for calcined raw meal, 16 for fuel and 15 for combustion air as well as an exhaust gas passage 22 to the calciner 4. The reactor 6 is internally fitted with an insulating refractory lining.

The calcined raw meal flows from the inlet pipe 14 down along the conical wall 21 of the reactor 6 and is captured at the bottom of the conical part 21 by the combustion air flowing up through the duct 15, thus forming a spouted bed in the cylindrical 20 of the reactor. As indicated with arrows in the cylindrical vessel 20, the material is circulating in the reactor in a characteristic vertical pattern and is progressively built up into clinker with increasing particle dimensions. After having attained such a predetermined size that the clinker weight is greater than the force induced by the updraft in the reactor, the finished clinker will fall down into the conical part 21 and move down through the pipe 15 to the first cooler 7. The predetermined size of the clinker depends on the setting of the volume and thereby the velocity of the air flowing up through the pipe 15.

Because of the characteristic circulating motion of the clinker in the reactor 6, the temperature will be distributed evenly across the entire cross-sectional area of the reactor. The pipe 15 has a free opening down into the cooler 7, providing a very simple classifier for the finish-burned clinker.

The calcined raw meal being fed to the reactor 6 is practically fully calcined in that the raw meal has been calcined in the calciner to a degree of calcination of more than 98% and at a temperature higher than 950° C. Because of the exothermic process in the reactor it will, under certain circumstances, not be necessary to add fuel to the reactor, but the reactor is provided with the fuel supply pipe 16 in case the temperature for burning of cement clinker is not automatically elevated to a required level.

As it appears from the drawing and the above description, the solution with a reactor according to the present invention offers a much simpler apparatus than known from the prior art, namely an apparatus without pressure loss-incurring connections between the calciner 4 and the reactor 6 and between the reactor 6 and the first cooler 7.

Further, the flow of combustion air to the stationary reactor can be set much higher than the minimum air volume required for combustion of maximum fuel in the reactor, so that the temperature in the reactor can be controlled solely by adjusting the fuel supply without changing the air volume, thus maintaining the desired size of clinker which falls down through the pipe 15 to the cooler 7.

The air flow up through the pipe 15 and hence the clinker size of the finish-burned clinker can thus be controlled solely by means of the blower 17.

Figure 3:
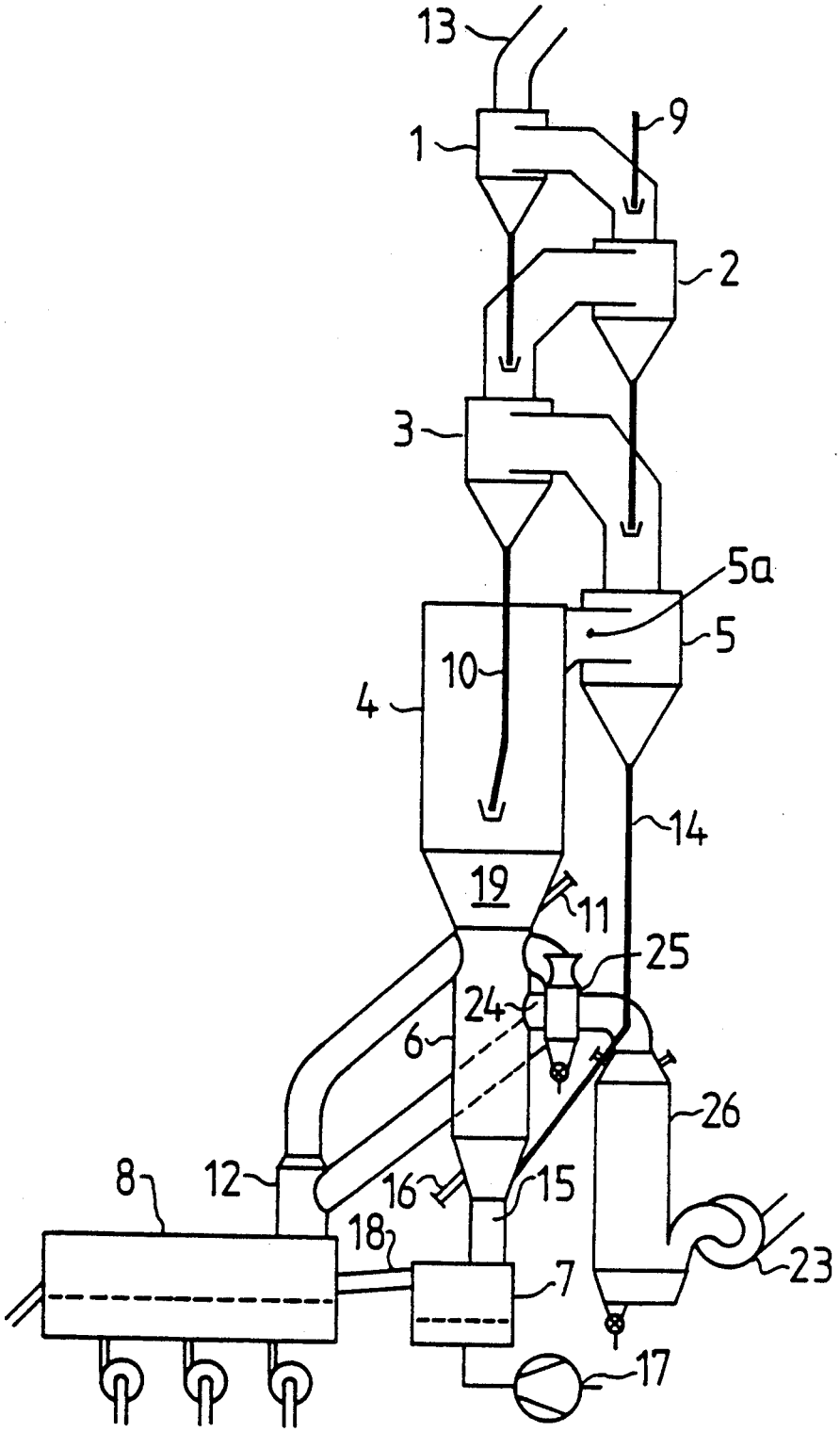

FIG. 3 shows a variant of FIG. 1, where the plant further comprises means for removal of a portion of the exhaust gas from the reactor 6 prior to entry of the exhaust gas unto the calciner 4 so as to reduce the alkali content in the clinker. The alkalis will evaporate, provided that the temperature in the spouted bed is sufficiently high, and some of these alkalis can then be extracted together with the above-mentioned portion of the exhaust gas.

For this purpose a fan 23 is provided for extracting the exhaust gas/alkali portion from the reactor 6 via an outlet 24 and, for example as shown, vented to a mixing chamber 25 in which the exhaust gas is mixed with fresh air and passed throught a cooling tower 26 where water is added. The alkalis thus condensed can subsequently be separated in a precipitator, not shown, and the exhaust gas vented to a stack.

I claim:

1. In a method for producing cement clinker from a raw meal comprising preheating means, a calciner, a stationary reactor and first and second clinker coolers, said method comprising the steps of (a) preheating the raw meal in the preheating means by passing hot exhaust gas from the calciner through the preheating means, (b) passing the preheated raw meal from the preheating means to the calciner, (c) supplying fuel to said calciner together with preheated combustion air from said second cooler and calcining said preheated raw meal, (d) passing the calcined raw meal upwardly out of said calciner and thence to the stationary reactor, and (e) supplying preheated air from said first cooler to said reactor and burning said calcined raw material in said reactor to form cement clinker, the improvement comprising the steps of (f) burning said raw meal in said reactor at a temperature of at least 950° C. in a spouted bed formed by blowing the preheated air from the first cooler into a lower portion of the reactor, (g) causing said raw material to form clinker particles in said reactor such that they reach a predetermined size, (h) controlling the volume of preheated air being blown into the reactor from the first cooler such that substantially only clinker of said predetermined size is caused by gravity to fall countercurrent to the upward path of the blown air and thence to fall into the first cooler.

2. A method according to claim 1, including the steps of supplying the reactor with fuel and burning said fuel in the reactor together with said calcined raw meal and preheated air, controlling the temperature in the reactor by adjusting the rate at which the fuel is supplied to the reactor while maintaining the volume of air blown into the reactor substantially constant.

3. A method according to claim 1, including the step of at least partly controlling the temperature in said reactor by adjusting the temperature of the calcined raw meal supplied from the calciner.

4. A method according to claim 2, including the step of at least partly controlling the temperature in said reactor by adjusting the temperature of the calcined raw meal supplied from the calciner.

5. A method according to claim 1, including the step of passing hot exhaust gas from the reactor to the calciner.

6. A method according to claim 5, including the step of removing a portion of the exhaust gas prior to passing the remainder into said calciner.

7. A method according to claim 5, including the step of passing hot exhaust gas from the reactor directly upwardly into the calciner without restriction by means of mounting said calciner centrally and immediately above said reactor.

8. A method according to claim 1, including the step of supplying preheated air from said first cooler to said reactor directly upwardly and without restriction by means of mounting said reactor immediately above said first cooler.

9. In an apparatus for producing cement clinker from raw meal, said apparatus comprising:

(a) preheater means for preheating said raw material before it is calcined in a calciner, (b) said calciner, (c) a stationary reactor comprised of an upright cylindrical vessel having at its lower end a frusto-conical wall, (d) a first clinker cooler, and (e) a second clinker cooler, the improvement wherein a bottom of said frusto-conical wall is in open and direct connection with said first clinker cooler through a common vertical central duct, said duct positioned and adapted so as to permit the simultaneous passage of air upwardly from said first clinker cooler and clinker particles downwardly to said first clinker cooler, and wherein blower means are provided for blowing air through said first clinker cooler means and thence upwardly through said duct into said reactor, said blower means being adjustable such that the volume of air blown through said duct will be sufficient to form a spouted bed in said reactor and yet permit substantially only clinker particles of at least a predetermined size to fall countercurrent to said volume of air directly into said first clinker cooler.

10. An apparatus according to claim 9, wherein said calciner is an upright cylindrical vessel with inlets for air, for exhaust gas, for fuel and for raw meal at a bottom thereof, and an outlet for exhaust gas with suspended particles at a top thereof, said outlet being connected with a separator for separation of calcined particles from said exhaust gas and supply of said particles to the stationary reactor.

11. An apparatus according to claim 9, wherein a diameter of said reactor is smaller than a diameter of said calciner, and wherein said reactor is located centrally and immediately below said calciner and connected therewith in such manner that said exhaust gas from said reactor can pass directly up into said calciner without any restriction.

12. An apparatus according to claim 9, wherein an exhaust gas passage between said reactor and said calciner is provided with an outlet for extraction of a portion of said exhaust gas.

* * * * *